US009568883B2

(12) United States Patent
Ito et al.

(10) Patent No.: US 9,568,883 B2
(45) Date of Patent: Feb. 14, 2017

(54) IMAGE FORMING APPARATUS WITH A STRUCTURE FOR REMOVING RESIDUAL DEVELOPER

(71) Applicant: Konica Minolta, Inc., Chiyoda-ku, Tokyo (JP)

(72) Inventors: Yohei Ito, Toyokawa (JP); Tsugihito Yoshiyama, Toyohashi (JP); Yoshiki Nakane, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/943,644

(22) Filed: Nov. 17, 2015

(65) Prior Publication Data

US 2016/0161900 A1 Jun. 9, 2016

(30) Foreign Application Priority Data

Dec. 5, 2014 (JP) ..... 2014-247096

(51) Int. Cl.
*G03G 21/10* (2006.01)

(52) U.S. Cl.
CPC ..... *G03G 21/10* (2013.01)

(58) Field of Classification Search
CPC ..... G03G 21/0023; G03G 21/0047; G03G 21/007
See application file for complete search history.

(56) References Cited

U.S. PATENT DOCUMENTS 7,738,807 B2 * 6/2010 Inada ..... G03G 21/0011 399/71

FOREIGN PATENT DOCUMENTS

| | | |
|---|---|---|
| JP | 2003-233282 A | 8/2003 |
| JP | 2005-099153 | 4/2005 |
| JP | 2005-257787 A | 9/2005 |
| JP | 2006-243657 | 9/2006 |
| JP | 2013-195559 | 9/2013 |

OTHER PUBLICATIONS

JP_2005257787_A_T Machine Translation, Japan, Ueno, Sep. 2005.*

Notification of Reasons for Refusal issued in corresponding Japanese Patent Application No. 2014-247096, mailed Nov. 1, 2016, with English translation (11 pages).

* cited by examiner

*Primary Examiner* — Clayton E Laballe
*Assistant Examiner* — Victor Verbitsky
(74) *Attorney, Agent, or Firm* — Buchanan Ingersoll & Rooney PC

(57) ABSTRACT

An image forming apparatus having: an image supporting member; a developing device configured to supply a developer to the image supporting member to develop a latent image; a transfer member configured to transfer the developed image from the image supporting member to a transfer medium; a blade configured to remove the developer left on the image supporting member after transfer therefrom; a storing member located downstream from the transfer member and upstream from the blade, the storing member configured to temporarily store a part of the developer left after transfer therein; and a control unit. The storing member is controlled by the control unit to release the temporarily stored developer therefrom toward the image supporting member after a lapse of a predetermined time from when an image density of an image to be formed becomes lower than a predetermined value.

7 Claims, 9 Drawing Sheets

1, 1A, 1B

IMAGE FORMING APPARATUS WITH A STRUCTURE FOR REMOVING RESIDUAL DEVELOPER

This application claims benefit of priority to Japanese Patent Application No. 2014-247096 filed Dec. 5, 2014, the entire content of which is incorporated herein by reference.

BACKGROUND OF THE INVENTION

1. Filed of the Invention

The present invention relates to an image forming apparatus, and more particularly to an image forming apparatus having a structure for removing developer left on an image supporting member therefrom with a blade.

2. Description of Related Art

In an electrophotographic image forming apparatus, a toner image is formed on a photoreceptor surface, which serves as an image supporting member. The toner image is transferred from the photoreceptor surface to a transfer member such as an intermediate transfer belt or the like. Developer, which contains toner, left on the photoreceptor surface after the image transfer, is removed therefrom with a blade arranged to contact with the photoreceptor surface.

In this regard, while the developer left on the photoreceptor surface after the image transfer is removed with the blade, the developer serves as a lubricant between the photoreceptor surface and the blade. Therefore, there is a possibility that a shortage of developer on the photoreceptor surface would cause curling of the blade. Image forming apparatuses taking measures to avoid this trouble are known. For example, in an image forming apparatus disclosed in Japanese Patent Laid-Open Publication No. 2005-257787, a brush temporarily storing a part of developer left after image transfer is arranged immediately upstream from a blade in a rotating direction of the photoreceptor. In such a conventional image forming apparatus, when the image density that is the ratio of the square measure of an image area to the square measure of a print medium becomes low, that is, when the amount of developer supplied from a developing device to a photoreceptor surface decreases, the developer stored in the brush is released.

Incidentally, only a limited amount of developer can be stored in the brush. In the conventional image forming apparatus, therefore, in such cases as a case of forming low-density images continuously, a shortage of developer on the photoreceptor surface cannot be resolved by the release of developer from the brush, thereby causing trouble such as curling of the blade.

SUMMARY OF THE INVENTION

An object of the present invention is to provide an image forming apparatus having a structure for removing developer left on an image supporting member with a blade, wherein the risk of curling of the blade can be reduced.

An image forming apparatus according to an embodiment of the present invention comprises: an image supporting member; a developing device configured to supply a developer used to develop a latent image formed on the image supporting member to the image supporting member; a transfer member configured to transfer the developed image from the image supporting member to a transfer medium; a blade configured to remove the developer left on the image supporting member after transfer therefrom; a storing member located downstream from the transfer member and upstream from the blade, the storing member configured to temporarily store a part of the developer left after transfer therein; and a control unit configured to control each component, wherein the storing member is controlled by the control unit to release the temporarily stored developer therefrom toward the image supporting member after a lapse of a predetermined time from when an image density, which is a ratio of a square measure of an image area to a square measure of a print medium, of an image to be formed becomes lower than a predetermined value.

DETAILED DESCRIPTION OF THE DRAWINGS

Figure 1:
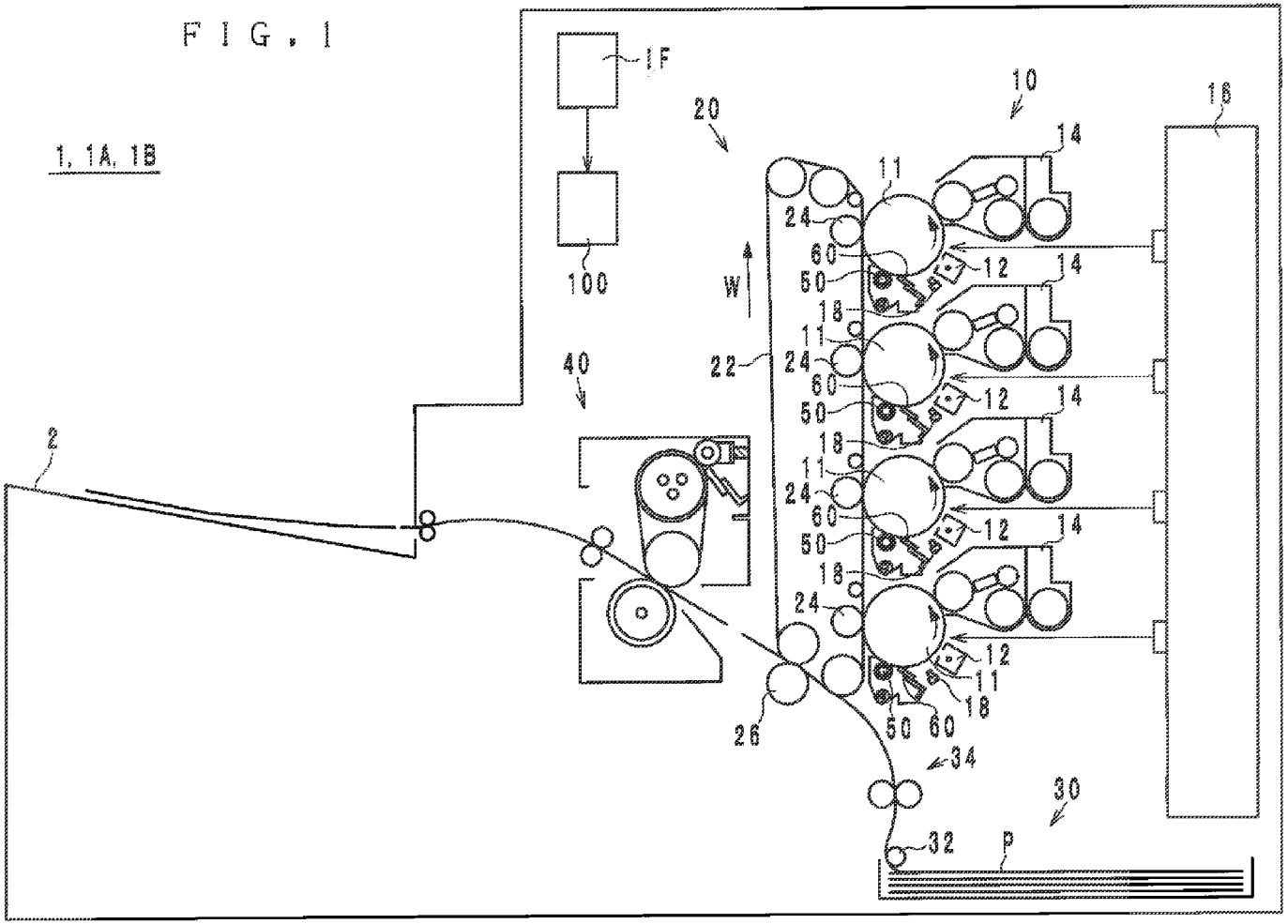
FIG. 1 is a schematic view of an image forming apparatus, indicating the internal structure thereof.

General Structure of Image Forming Apparatus; See FIG. 1

An image forming apparatus 1 according to an embodiment will hereinafter be described with reference to the drawings. In the drawings, the same parts and members are provided with the same reference symbols, and repetitions of the same description will be avoided.

The image forming apparatus 1 is an electrophotographic color printer of a tandem type, and as illustrated in FIG. 1, the image forming apparatus 1 comprises imaging units 10 configured to form toner images in colors of Y (yellow), M (magenta), C (cyan) and K (black) respectively, an intermediate transfer unit 20, and a control unit 100 configured to control each part of the image forming apparatus 1.

Each of the imaging units 10 includes a photoreceptor drum 11, and an electric charger 12, a developing device 14 and other devices arranged around the photoreceptor drum 11. The photoreceptor drum 11 is irradiated with light emitted from a laser scanning optical unit 16, and thereby, an electrostatic latent image is formed on the photoreceptor drum 11. The electrostatic latent image is developed into a toner image by the developing device 14. The intermediate transfer unit 20 includes an intermediate transfer belt 22 that is an endless belt driven to rotate in a direction indicated by arrow W. First transfer rollers 24 are arranged to face the respective photoreceptor drums 11, and by the effects of the electric fields generated by the first transfer rollers 24, the toner images formed on the respective photoreceptor drums 11 are transferred onto the intermediate transfer belt 22 so as to be combined with one another to form a composite image (first transfer). After the image transfer, a part of developer left on each of the photoreceptor drums 11 is stored in a brush 50, which will be described later, and the other part of developer is removed with a blade 60, which will be described later. Thereafter, the entire surface of each of the photoreceptor drums 11 is exposed to light emitted from an erasure device 18, and thereby, an electrostatic latent image remained on the photoreceptor drum 11 is erased. Such an image forming process by electrophotography is well known, and a detailed description thereof is omitted.

In a lower portion of the body of the image forming apparatus 1, an automatic sheet feeder unit 30 configured to feed transfer media (which will hereinafter be referred to as sheets) one by one is located. Each sheet is fed out by a feed roller 32 and fed into a nip portion between the intermediate transfer belt 22 and a second transfer roller 26 through a pair of timing rollers 34. Then, by the effect of an electric field generated by the second transfer roller 26, the toner image (composite color image) is transferred onto the sheet (second transfer). Thereafter, the sheet is fed to a fixing unit 40, where the sheet undergoes a heating treatment for toner fixation thereon, and the sheet is ejected on a tray section 2 located on the upper surface of the body of the apparatus 1.

Description of Components Involving in Removal of Developer from the Surface of Each Photoreceptor Drum; See FIG. 2

Figure 2:
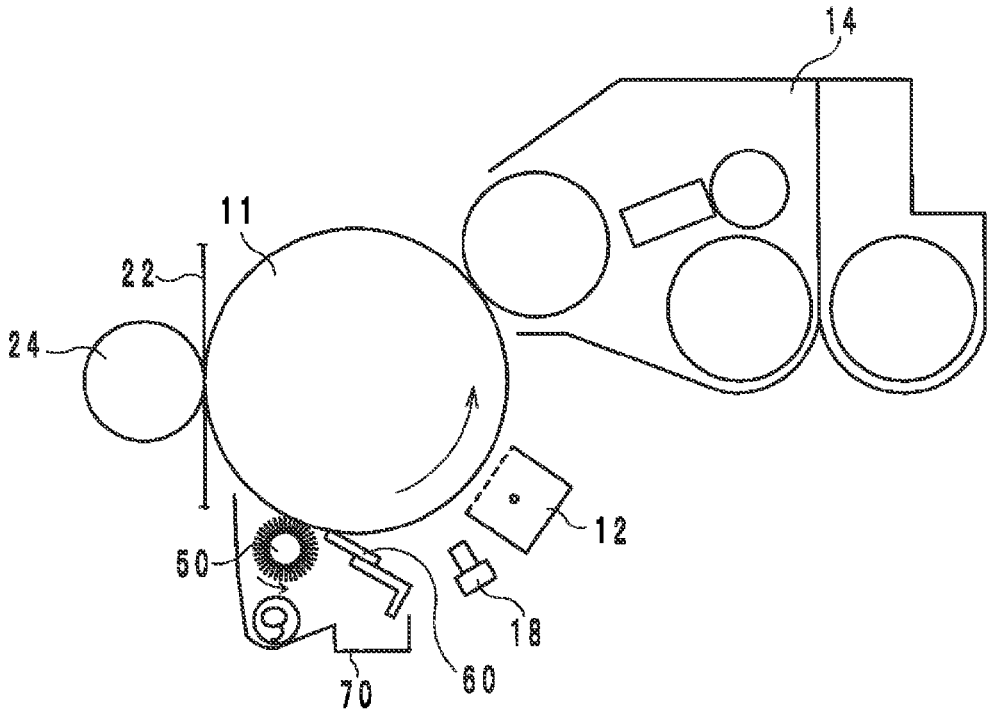
FIG. 2 illustrates members around a photoreceptor drum.

In the image forming apparatus 1 according to the embodiment, as seen in FIG. 2, an electric charger 12, a developing device 14, a first transfer roller 24 and an erasure device 18 are provided around each of the photoreceptor drums 11. Additionally, a brush 50 and a blade 60, which involve in removal of developer from the surface of the photoreceptor drum 11 are provided. Further, a waste toner box 70 is provided so as to enclose the brush 50 and the blade 60. In this embodiment, the developer left on the surface of the photoreceptor drum 11 after image transfer contains toner and antifriction, and the antifriction is made of zinc stearate which serves to reduce the coefficient of friction of the surface of the photoreceptor drum 11. Other materials such as magnesium stearate, lithium stearate, etc. can be used as the antifriction.

The brush 50 temporarily stores a part of the developer left on the surface of the photoreceptor drum 11 after image transfer, and the brush 50 has a fabric provided on the surface of an iron cylindrical rod. The diameter ϕ of the iron cylindrical rod is 8 mm, and the iron cylindrical rod is arranged such that the central axis thereof is parallel to the rotation axis of the photoreceptor drum 11. The brush 50 rotates on the central axis of the iron cylindrical rod. Also, the brush 50 is arranged such that the fabric on the surface thereof contacts with the surface of the photoreceptor drum 11. Accordingly, while the photoreceptor drum 11 is rotating, the fabric on the surface of the brush 50 scrapes and stores a part of developer left on the photoreceptor drum 11. In this moment, the brush 50 rotates in the same direction as the photoreceptor drum 11, and accordingly, in the place where the photoreceptor drum 11 and the brush 50 contact with each other, the photoreceptor drum 11 and the brush 50 move counter to each other. The rotation speed of the brush 50 is 1.3 times the rotation speed of the photoreceptor drum 11 in terms of linear speed.

An exemplary detailed specification of the brush 50 will hereinafter be given. The fabric of the brush 50 is conductive polyester and has a resistance value of $10^8\Omega$ as fibers. The fabric of the brush 50 comprises looped fibers, and each fiber has a thickness of 10T (decitex). The fabric has a fiber density of 50 KF/inch$^2$. The outside diameter ϕ of the brush 50 is 14 mm. The fibers are provided on a foundation cloth having a thickness of about 0.5 mm, and the lengths of the fibers are about 2.5 mm.

The blade 60 is a polyurethane rubber sheet, and is bonded to a holding metal plate by a hot-melt adhesive. The blade 60 is pushed against the photoreceptor drum 11, and while the photoreceptor drum 11 is rotating, the blade 60 removes toner etc. left on the photoreceptor drum 11 after image transfer.

The waste toner box 70 is a box-like member, and waste toner etc. removed from the photoreceptor drum 11 after image transfer by the blade 60 is stored in the waste toner box 70.

Control of the Amount of Developer on the Surface of the Photoreceptor Drum; See FIGS. 3-8

Next, control of the amount of developer on the surface of the photoreceptor drum 11 is described. In the following, control at a normal time when ordinary-density images having image densities of 5% or more are formed and control at a time of low-density image formation when low-density images having image densities less than 5% are formed will be described.

Figure 3:
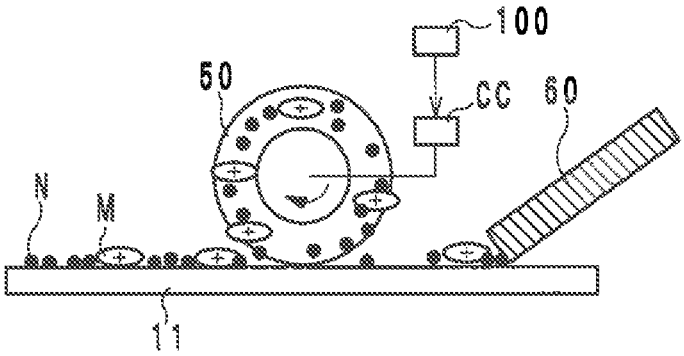
FIG. 3 is a sectional view indicating the state of developer on the surface of the photoreceptor drum at a normal time.

At a normal time, as illustrated in FIG. 3, on the surface of the photoreceptor drum 11 after image transfer, toner N and antifriction M of a developer are left. A part of the developer is stored in the brush 50 that is in contact with the photoreceptor drum 11, and the other part of the developer is scraped and removed from the surface of the photoreceptor drum 11 by the blade 60.

At a normal time, an amount of toner N and antifriction M equal to or more than a specified amount comes to the blade 60. The toner N and the antifriction M that have come to the blade 60 serve as a lubricant between the blade 60 and the photoreceptor drum 11 while being scraped by the blade 60. Thus, at a normal time, since there is an adequate amount of toner N and antifriction M between the blade 60 and the photoreceptor drum 11, there is almost no possibility that a shortage of toner N and antifriction M would cause curls and abrasions of the blade 60.

Figure 4:
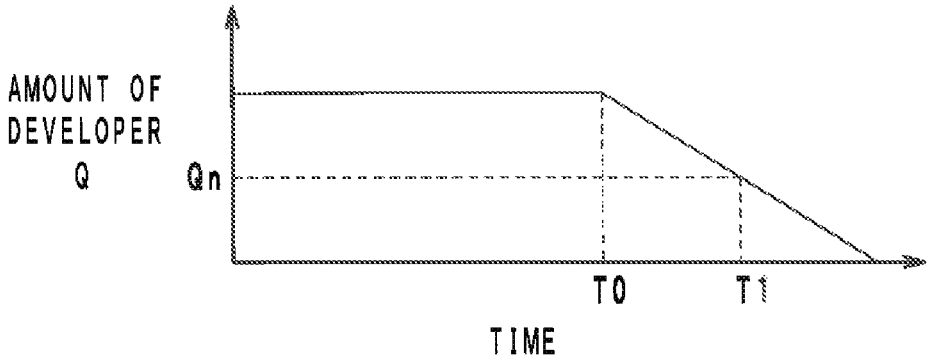
FIG. 4 is a graph indicating the relation between the amount of developer on the surface of the photoreceptor drum and time.
Figure 5:
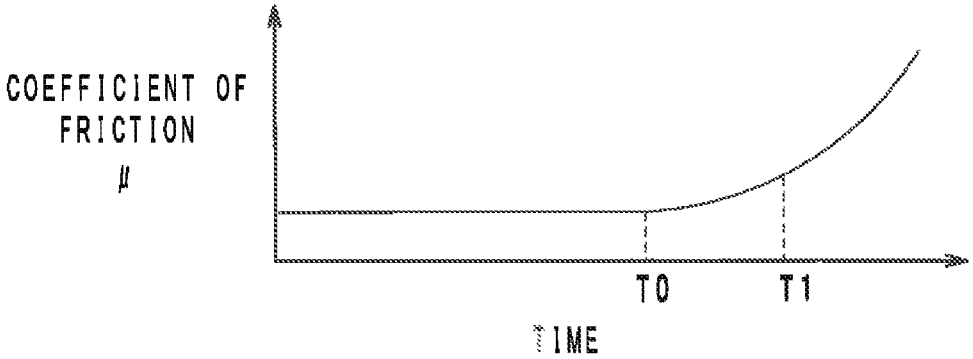
FIG. 5 is a graph indicating the relation between the coefficient of friction of the surface of the photoreceptor drum and time.

At a time of low-density image formation, the amount of developer supplied from the developing device 14 to the photoreceptor drum 11 is decreased. Accordingly, the amount of toner N and antifriction M left on the surface of the photoreceptor drum 11 after image transfer is decreased, and the amount of toner N and antifriction M coming to the blade 60 is decreased. In this case, as illustrated in FIG. 4, although an amount of developer more than a specified amount is left on the surface of the photoreceptor drum 11 at time T0 immediately after a start of low-density image formation, the amount of toner and antifriction coming to the blade 60 at and after time T1 after a lapse of a specified time after the start of low-density image formation becomes lower than an amount Qn required for lubrication between the blade 60 and the photoreceptor drum 11. Accordingly, as illustrated in FIG. 5, the coefficient of friction p of the surface of the photoreceptor drum 11 becomes higher. Consequently, there is a possibility of curls and abrasions of the blade 60.

In order to avoid this trouble, in the image forming apparatus 1, the toner N and the antifriction M stored in the brush 50 are released at a time of low-density image formation. The release is carried out after a lapse of a predetermined time from a drop of the image density below a predetermined value. This is because an amount of developer equal to or more than a specified amount is left on the surface of the photoreceptor drum 11 at time T0 immediately after a start of low-density image formation, thereby permitting a contact portion between the blade 60 and the photoreceptor drum 11 to be supplied with an adequate amount of toner and antifriction continuously from time T0 to time T1 for the period of the predetermined time.

Figure 6:
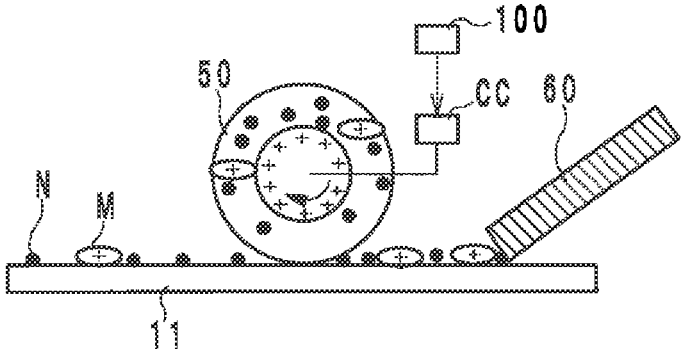
FIG. 6 is a sectional view indicating the state of developer on the photoreceptor drum when developer is released from the brush after a lapse of a predetermined time.
Figure 7:
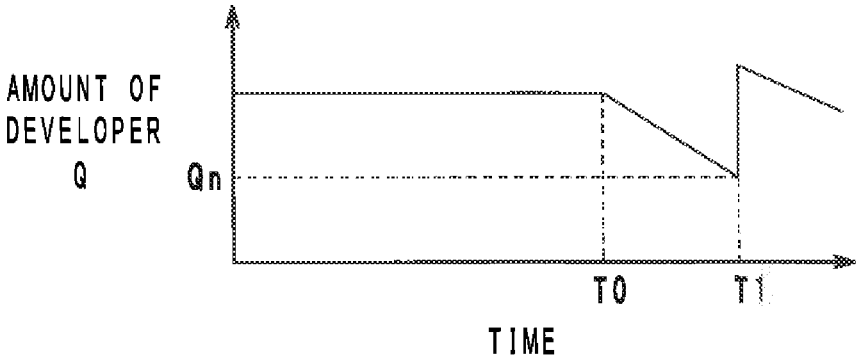
FIG. 7 is a graph indicating the relation between the amount of developer on the surface of the photoreceptor drum and time in a case in which developer is released from the brush after a lapse of a predetermined time.
Figure 8:
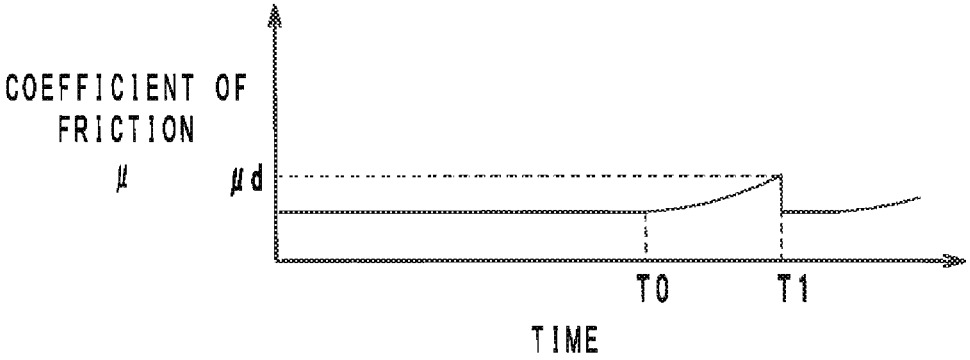
FIG. 8 is a graph indicating the relation between the coefficient of friction of the surface of the photoreceptor drum and time in a case in which developer is released from the brush.

The release of toner N and antifriction M from the brush 50 is carried out by use of an electric potential difference between the photoreceptor drum 11 and the brush 50. Specifically, in this embodiment, the toner N is negatively charged, and the antifriction M is positively charged. At a normal time, an electric potential control circuit CC maintains the brush 50 at the same electric potential level as the photoreceptor drum 11. At time T1 after a lapse of the predetermined time from a drop of the image density below the predetermined value, for example, the control unit 100 drives the electric potential control circuit CC to charge the brush 50 positively relative to the photoreceptor drum 11, as illustrated in FIG. 6. Thereby, the antifriction M stored in the brush 50 is released, and as illustrated in FIG. 7, even after time T1, an adequate amount of antifriction M comes to the blade 60. Consequently, as illustrated in FIG. 8, the coefficient of friction p of the surface of the photoreceptor drum 11 is prevented from rising to a value pd that causes curls and abrasions of the blade 60.

Control of Electric Potential of Brush; See FIGS. 9-11

As mentioned above, the release of the stored developer from the brush 50 is carried out by a change in the electric potential of the brush 50 relative to the electric potential of the photoreceptor drum 11, and the change in the electric potential of the brush 50 is made by the electric potential control circuit CC under control of the control unit 100. The control of the electric potential of the brush 50 under control of the control unit 100 will hereinafter be described.

Figure 9:
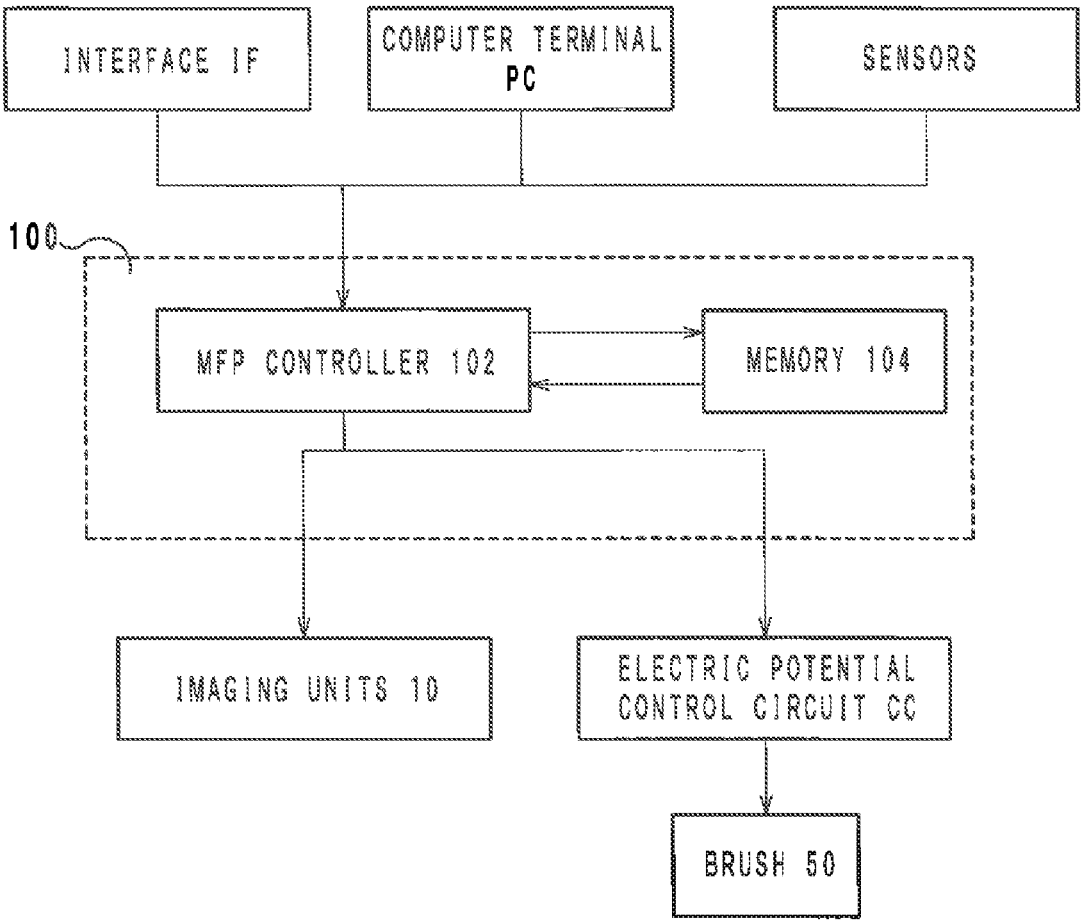
FIG. 9 is a block diagram indicating the relation among components involving in electric potential control of the brush.

At the start of control of the electric potential of the brush 50, as illustrated in FIG. 9, an MFP controller 102 of the control unit 100 obtains information from a user interface IF attached to the image forming apparatus 1, a computer terminal PC connected to the image forming apparatus 1, various sensors provided in the image forming apparatus 1, etc. The information is stored in a memory 104 of the control unit 100. Then, the MFP controller 102 sends an image formation command to each of the imaging units 10 based on the information. Further, in response to a command from the MFP controller 102, the control unit 100 changes the electric potential of the brush 50 relative to that of the photoreceptor drum 11 via the electric potential control circuit CC. In the following, a control flow for release of antifriction from the brush 50 and a control flow for release of toner from the brush 50 will be described.

Release of Antifriction

Figure 10:
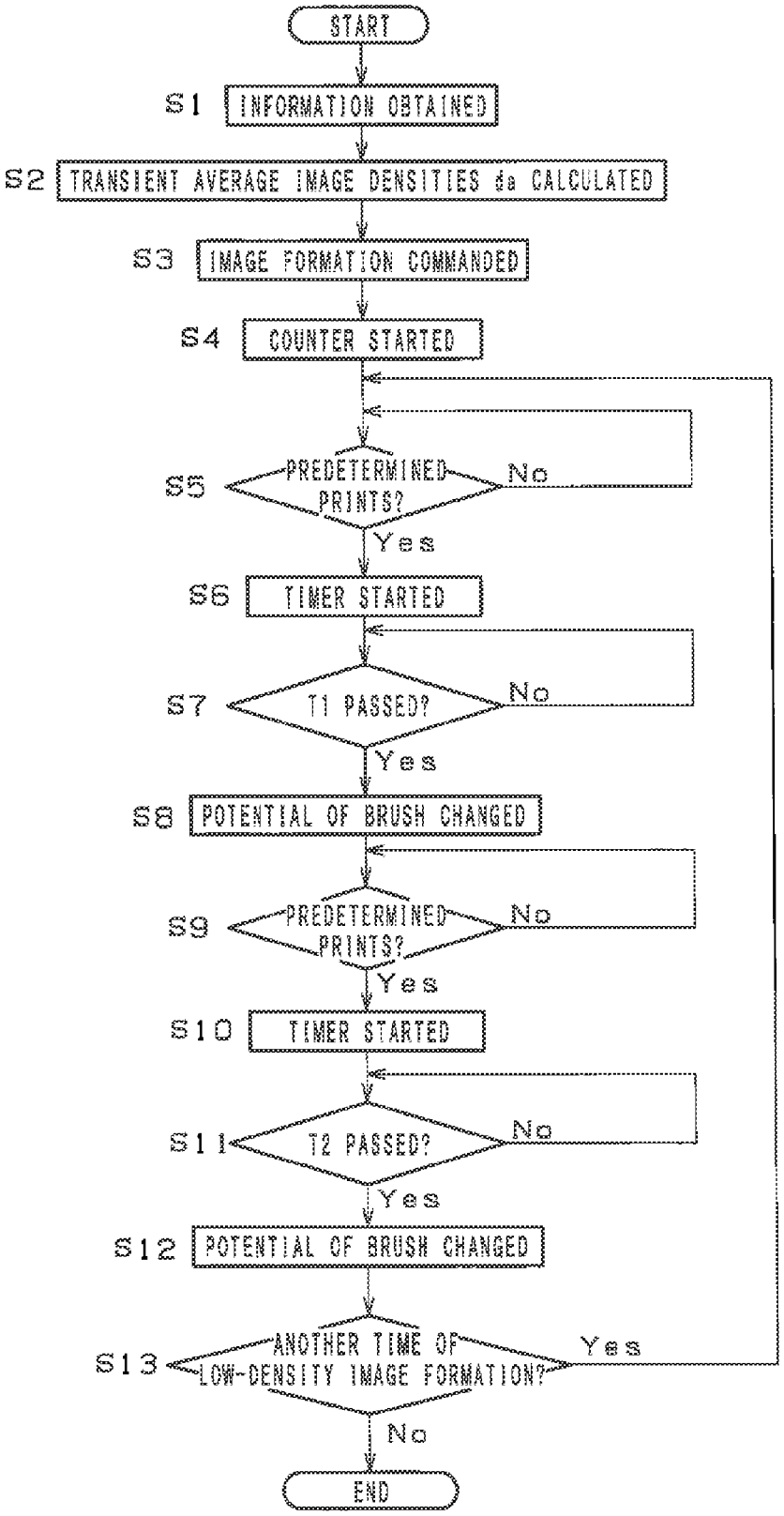
FIG. 10 is a flowchart indicating electric potential control of the brush for release of a lubricant.

First, a control procedure for release of antifriction is described with reference to FIG. 10. This control procedure starts when execution of a print job is newly determined.

At step S1 of this control procedure, the control unit 100 obtains information about the square measures (sizes) of sheets to be printed, the square measures of image forming areas and the image densities of images to be formed.

At step S2, the control unit 100 calculates transient average image densities da from the information obtained at step S1. Each of the transient average image densities da is calculated as follows, for example. A transient average image density of an image to be formed is calculated from image densities of three images, namely, the image density of the image to be formed on a next one sheet (which will be referred to as a current image density) and the image densities of two images lastly formed. If the current image density, the image density of the last image and the image density of the second last image are 4%, 3% and 5% respectively, the transient average image density da of the image to be formed on the next one sheet is calculated as follows.

$$\text{Transient average image density } da=(4+3+5)/3=4(\%)$$

The number of samples for calculation of each transient average image density da is not limited to three, and may be set arbitrarily, for example, to ten or fifty.

At step S2, the control unit 100 calculates the transient average image densities da of all of the images to be formed in the print job, and stores the calculation results in a memory 104 of the control unit 100. Accordingly, the control unit 100 can predict whether or not the print job includes a time of low-density image formation (a time when low-density images are continuously formed) and at what time of the print job it will come to the time of low-density image formation.

At step S3, the control unit 100 sends an image formation command to the imaging units 10.

At step S4, the control unit 100 starts a counter configured to count the number of prints made by the imaging units 10 during the print job.

At step S5, the control unit 100 determines whether or not the number of prints made by the imaging units 10 has reached a predetermined number that indicates a time of low-density image formation. More specifically, the control unit 100 determines whether or not it is the time to form an image of which transient average image density is less than 5%. When the number of prints made by the imaging units 10 has reached the predetermined number, the control procedure goes to step S6. The control procedure stands by at step S5 until the number of prints has reached the predetermined number.

At step S6, the control unit 100 starts a timer configured to measure a time T1. The time T1 is a period of time from when the low-density image formation starts till when the control unit 100 issues a command to change the electric potential of the brush 50 to a positive value relative to that of the photoreceptor drum 11.

At step S7, the control unit 100 determines whether or not the time T1 has passed. When the time T1 has passed, the control procedure goes to step S8. The control procedure stands by at step S7 until the time T1 has passed.

At step S8, the control unit 100 issues a command to change the electric potential of the brush 50 to a positive value relative to that of the photoreceptor drum 11. Thereby, the antifriction stored in the brush 50 is released.

At step S9, the control unit 100 determines whether or not the number of prints made by the imaging units 10 has reached a predetermined number that indicates a start time of ordinary-density image formation after the low-density image formation. Specifically, the control unit 100 determines whether or not it is the first time after the low-density image formation to form an image of which transient average image density is equal to or higher than 5%. When the number of prints has reached the predetermined number, the control procedure goes to step S10. The control procedure stands by at step S9 until the number of prints has reached the predetermined number.

At step S10, the control unit 100 starts a timer configured to measure a time T2. The time T2 is a period of time from when the ordinary-density image formation starts till when the control unit 100 issues a command to return the electric potential of the brush 50 relative to the photoreceptor drum 11 to a normal level.

At step S11, the control unit 100 determines whether or not the time T2 has passed. When the time T2 has passed, the control procedure goes to step S12. The control procedure stands by at step S11 until the time T2 has passed.

At step S12, the control unit 100 issues a command to cause the brush 50 to have no potential difference from the photoreceptor drum 11. Thus, the electric potential of the brush 50 is returned to a normal level. Thereby, the release of antifriction from the brush 50 is stopped. The reason why the electric potential of the brush 50 is returned to the normal level after a lapse of the time T2 from the start of ordinary-density image formation is that the amount of antifriction on the photoreceptor drum 11 does not return to the normal level so quickly. Specifically, since the antifriction is positively charged, the antifriction moves from the developing device to the photoreceptor drum 11 even during low-density image formation, and accordingly, the amount of antifriction in the developing device decreases during low-density image formation. Consequently, even when the developer is supplied from the developing device to the photoreceptor drum 11 at the start of ordinary-density image formation, the amount of antifriction in the developer at that time is less, and the amount of antifriction on the photoreceptor drum 11 does not return quickly. Thus, since the amount of antifriction on the photoreceptor drum 11 does not return quickly, the electric potential of the brush 50 is returned to the normal level after a lapse of the predetermined time from the start of ordinary-density image formation. Thereby, the amount of antifriction on the photoreceptor drum 11 can be maintained more effectively. After the start of ordinary-density image formation, the amount of toner on the photoreceptor drum 11 returns to a normal level more quickly than the amount of antifriction.

At step S13, the control unit 100 determines whether or not there will be another time of low-density image formation during the current print job. If the control unit 100 determines that there will be another time of low-density image formation, the control procedure returns to step S5. If the control unit determines that there will be no other time of low-density image formation, the control procedure ends. In a case in which the print job completes with a time of low-density image formation, after a lapse of a predetermined time from when the electric potential of the brush 50 is changed to a positive value relative to that of the photoreceptor drum 11, the electric potential of the brush 50 is returned to the normal level, and then, the control procedure ends.

Release of Toner

Figure 11:
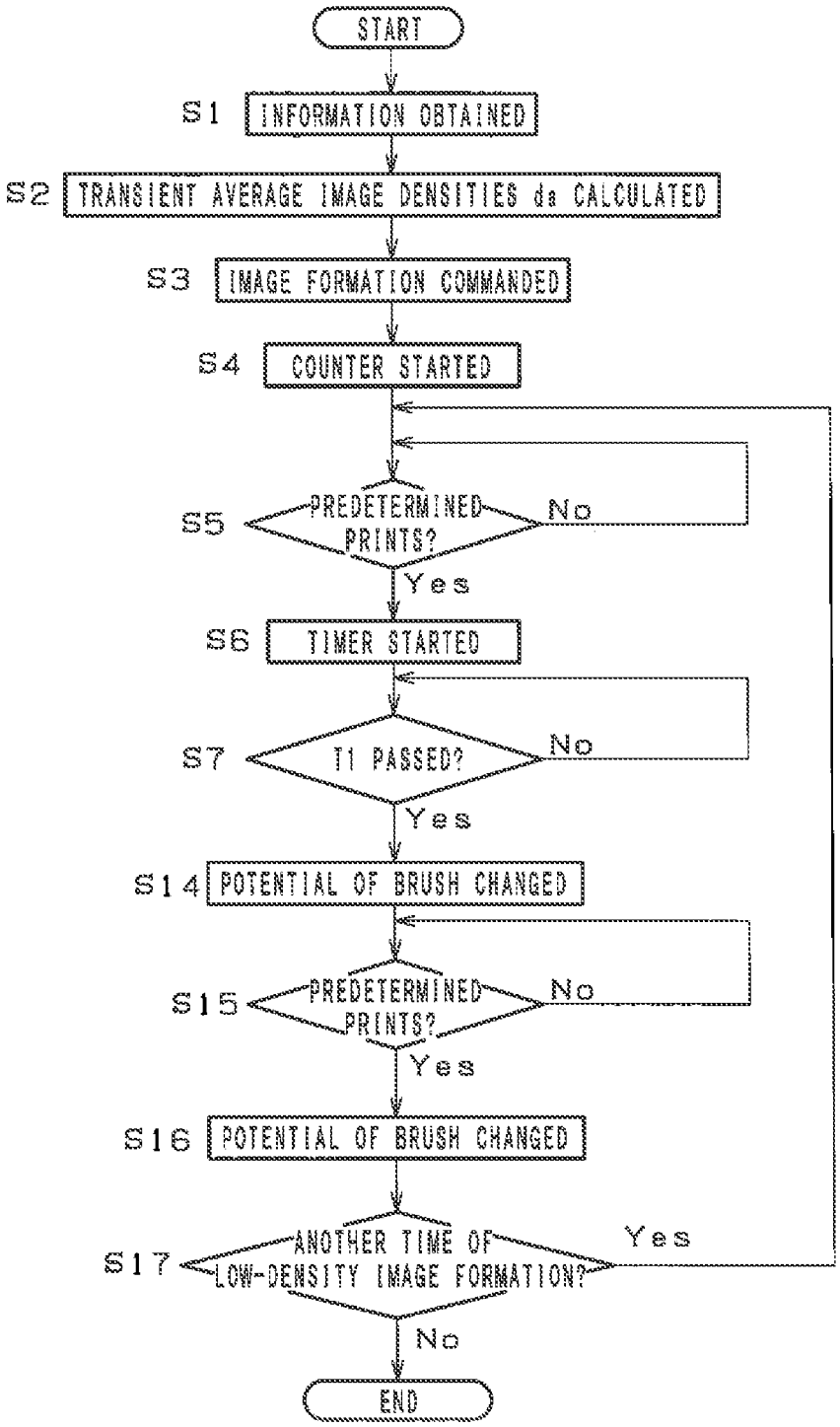
FIG. 11 is a flowchart indicating electric potential control of the brush for release of toner.

Next, a control procedure for release of toner is described with reference to FIG. 11.

As is the case with the control procedure for release of antifriction, the control procedure for release of toner starts when execution of a print job is newly determined. Steps S1-S7 of this control procedure for release of toner are the same as those of the control procedure for release of antifriction, and these steps are not described here. The control procedure for release of toner proceeds from step S7 to step S14.

At step S14, the control unit 100 issues a command to change the electric potential of the brush 50 to a negative value relative to that of the photoreceptor drum 11. Thereby, the toner stored in the brush 50 is released.

At step S15, the control unit 100 determines whether the number of prints made by the imaging units 10 has reached a predetermined number that indicates a start time of ordinary-density image formation after the low-density image formation. Specifically, the control unit 100 determines whether or not it is the first time after the low-density image formation to form an image of which transient average image density is equal to or higher than 5%. When the number of prints has reached the predetermined number, the control procedure goes to step S16. The control procedure stands by at step S15 until the number of prints has reached the predetermined number.

At step S16, the control unit 100 issues a command promptly to cause the brush 50 to have no potential difference from the photoreceptor drum 11 so as to stop the release of toner promptly. This is because at the start of ordinary-density image formation after low-density image formation, the amount of toner on the photoreceptor drum 11 after image transfer is returned to the normal level quickly as compared to the amount of antifriction. In this regard, in a case in which toner is to be released from the brush 50, the number of samples used for calculation of the transient average image density da of each image may be set to one, that is, the image density of the image to be formed may be determined as the transient average image density da of the image.

At step S17, the control unit 100 determines whether or not there will be another time of low-density image formation during the current print job. If the control unit 100 determines that there will be another time of low-density image formation, the control procedure returns to step S5. If the control unit determines that there will be no other time of low-density image formation, the control procedure ends. In a case in which the print job completes with a time of low-density image formation, after a lapse of a predetermined time from when the electric potential of the brush 50 is changed to a positive value relative to that of the photoreceptor drum 11, the electric potential of the brush 50 is returned to the normal level, and then, the control procedure ends.

Effects

In the image forming apparatus 1, the risk of curls and abrasions of the blade 60 can be reduced. The amount of developer on the surface of the photoreceptor drum 11 does not become insufficient quickly after the image density becomes lower than a predetermined value. Therefore, it is not necessary to release the developer stored in the brush toward the surface of the photoreceptor quickly after the image density becomes lower than the predetermined value. (In conventional image forming apparatuses, however, this control is carried out). Accordingly, in the image forming apparatus 1 according to the embodiment, after a lapse of a predetermined time from when the image density becomes lower than a predetermined value, the control unit 100 causes the brush 50 to release the developer stored therein toward the surface of the photoreceptor drum 11. Thereby, the finish time of the release of developer from the brush 50 can be postponed as compared to that in a conventional image forming apparatus. Consequently, in the image forming apparatus 1, the time period when the developer stays on the photoreceptor drum 11 after image transfer is lengthened as compared to that in a conventional image forming apparatus, and the risk of curves and abrasions of the blade 60 can be reduced.

Figure 12:
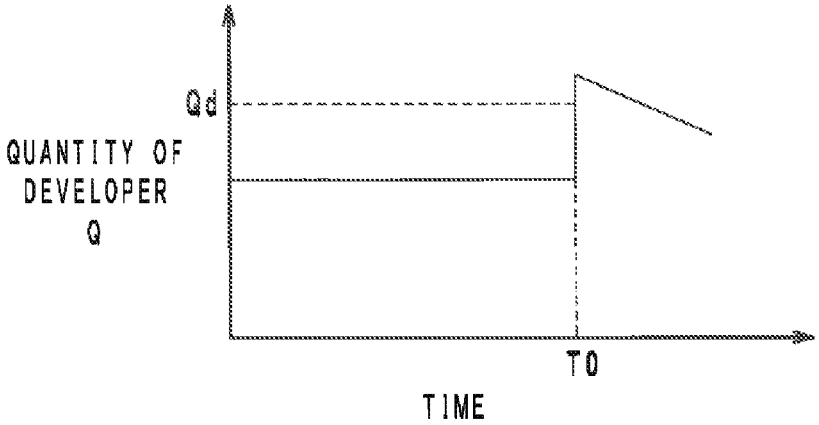
FIG. 12 is a graph indicating the relation between the amount of developer on the surface of the photoreceptor drum and time in a case in which developer is released from the brush quickly after formation of a low-density image.

In the image forming apparatus 1, also, the amount of developer on the photoreceptor drum 11 after image transfer can be maintained more appropriately as compared to that in a conventional image forming apparatus. As mentioned above, the amount of developer on the surface of the photoreceptor drum 11 does not become insufficient quickly after the image density becomes lower than a predetermined value. Therefore, if the developer stored in the brush is released therefrom toward the surface of the photoreceptor quickly after the image density becomes lower than the predetermined value as is the case with a conventional image forming apparatus, as seen in FIG. 12, the amount of developer on the surface of the photoreceptor may exceed a value Qd that is the maximum amount of developer that can be removed by the blade, thereby causing poor cleaning. In the image forming apparatus 1 according to the embodiment, however, the developer stored in the brush 50 is released therefrom toward the surface of the photoreceptor drum 11 after a lapse of a predetermined time from when the image density becomes lower than a predetermined value. Thereby, the developer is supplied to the surface of the photoreceptor drum 11 on the brink of a shortage of developer on the surface of the photoreceptor drum 11, and adhesion of an excess amount of developer to the surface of the photoreceptor drum 11 can be prevented. Thus, in the image forming apparatus 1, the amount of developer on the surface of the photoreceptor drum 11 after image transfer can be maintained more appropriately as compared to that in a conventional image forming apparatus.

In the image forming apparatus 1, further, the control unit 100 controls the brush 50 via the electric potential control circuit CC such that the brush 50 has a positive or negative electric potential relative to the photoreceptor drum 11, and thus, it is possible to drive the brush 50 to release toner or antifriction selectively therefrom. This permits, for example, an operation of the brush 50 to release toner therefrom when the amount of toner in the developer on the surface of the photoreceptor drum 11 is less and an operation of the brush 50 to release antifriction therefrom when the amount of antifriction in the developer on the surface of the photoreceptor drum 11 is less.

Application of this method of selective release of toner or antifriction permits the following control of release of toner and antifriction from the brush 50. A negative voltage is applied to the brush 50 for a predetermined time for release of toner from the brush 50, and subsequently, a positive voltage is applied to the brush 50 for release of antifriction from the brush 50. In this case, the effect to prevent curls and abrasions of the blade 60 lasts longer than that in a case in which only a negative voltage or a positive voltage is applied to the brush 50.

The amount of developer released from the brush 50 is proportional to the potential difference between the brush 50 and the photoreceptor drum 11. Therefore, in the image forming apparatus 1, the control unit 100 adjusts the amount of developer on the photoreceptor drum 11 after image transfer by changing the voltage applied to the brush 50 via the electric potential control circuit CC.

First Modification; See FIGS. 13 and 14

An image forming apparatus 1A according to a first modification differs from the image forming apparatus 1 according to the embodiment above in that a value is selected from among a plurality of values including T1 as the time period from when a time of low-density image formation starts till when the electric potential of the brush 50 is changed to a positive value relative to that of the photoreceptor drum 11.

Specifically, at step S6 of starting a timer in the control procedure of the electric potential of the brush, the control unit 100 selects a time from a table stored in the memory 104 as the time period till when the electric potential of the brush 50 is changed to a higher value relative to that of the photoreceptor drum 11. The time is selected depending on the density of the low-density image to be formed. For example, if the density of the low-density image to be formed is 3%, the time T1 is selected, and if the density of the low-density image to be formed is 2%, a time T2 shorter than the time T1 is selected. If the density of the low-density image to be formed is 1%, a time T3 shorter than the time T2 is selected.

Figure 13:
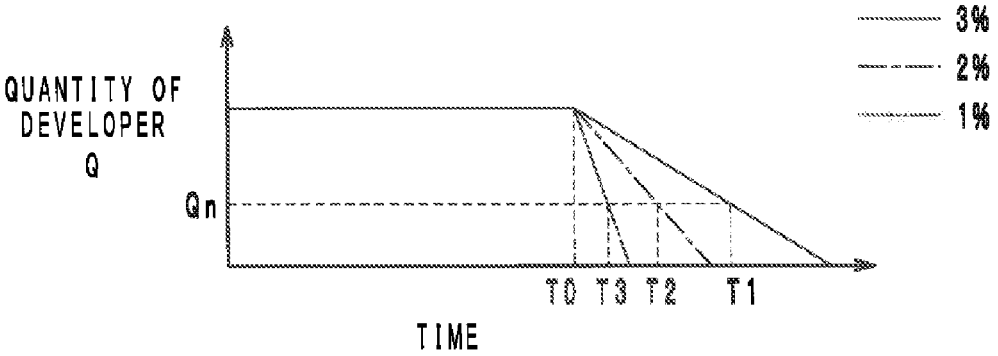
FIG. 13 is a graph indicating the relation between the amount of developer on the surface of the photoreceptor drum and time in various cases that differ in image density.
Figure 14:
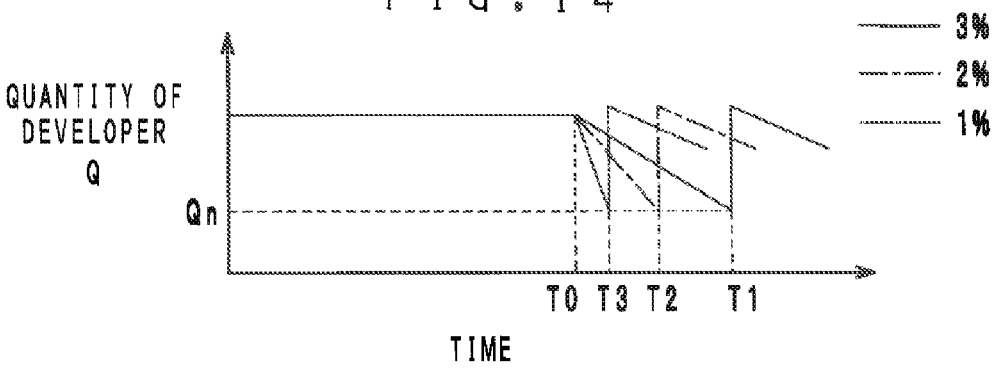
FIG. 14 is a graph indicating the relation between the amount of developer on the surface of the photoreceptor drum and time in each case in which developer is released from the brush after a lapse of a time predetermined depending on each image density.

In the image forming apparatus 1A having the structure above, it is possible to adjust the amount of developer on the photoreceptor drum 11 after image transfer more appropriately. Specifically, as seen in FIG. 13, the lower the density of the image to be formed is, the more quickly the amount of developer on the surface of the photoreceptor drum 11 will decrease. Therefore, by determining the time period till when the electric potential of the brush 50 is changed to a higher value relative to that of the photoreceptor drum 11 depending on the density of the image to be formed, it is possible to cope flexibly with a decrease in the amount of developer on the surface of the photoreceptor drum 11 as indicated in FIG. 14. Consequently, it is possible to adjust the amount of developer on the photoreceptor drum 11 after image transfer more appropriately. There is no other difference between the structure according to the first modification and the structure according to the embodiment above. Accordingly, the description of the embodiment above also applies to the first modification other than the point that a value is selected from among a plurality of values including T1 as the time period till when the electric potential of the brush 50 is changed to a higher value relative to that of the photoreceptor drum 11.

Second Modification; See FIGS. 15 and 16

Figure 15:
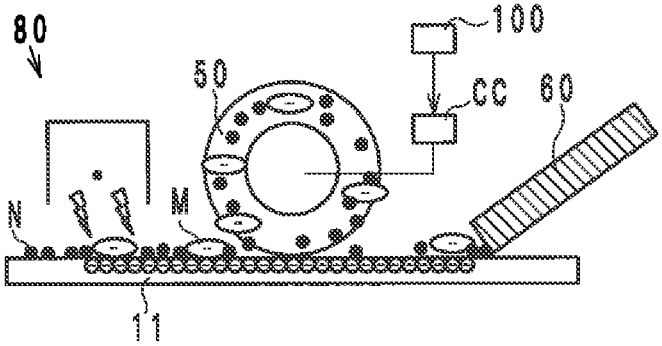
FIG. 15 is a sectional view indicating the state of developer on the surface of the photoreceptor drum at a normal time, in an image forming apparatus according to a second modification.
Figure 16:
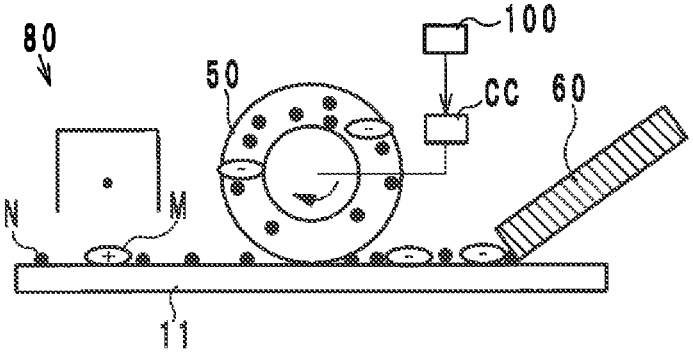
FIG. 16 is a sectional view indicating the state of developer on the photoreceptor drum when developer is released from the brush after a lapse of a predetermined time, in the image forming apparatus according to the second modification.

An image forming apparatus 1B according to a second modification, which is illustrated in FIGS. 15 and 16, differs from the image forming apparatus 1 according to the embodiment above in that a charger 80 is further provided in the image forming apparatus 1B.

The charger 80 is to charge an object negatively. The charger 80 is located downstream from the first transfer roller 24 and upstream from the brush 50. Accordingly, when the charger 80 is activated, the developer left on the surface of the photoreceptor drum 11 after image transfer is charged negatively while passing through the area where the charger 80 is located. In this moment, both of the toner and the antifriction contained in the developer are charged negatively. Also, the surface of the photoreceptor drum 11 is charged negatively.

In the image forming apparatus 1B having the structure above, the charger 80 is kept active at normal times. Thereby, the developer left on the surface of the photoreceptor drum 11 after image transfer is charged negatively, and the surface of the photoreceptor drum 11 is also charged negatively. However, the brush 50 is not charged negatively, that is, the brush 50 has a positive electric potential relative to the surface of the photoreceptor drum 11. In this state, the developer charged negatively by the charger 80 is absorbed by the brush 50 and stored in the brush 50. Thus, in the image forming apparatus 1B, the developer on the surface of the photoreceptor drum 11 is not only scraped by contact between the fabric of the brush 50 and the surface of the photoreceptor drum 11 but also absorbed by the brush 50 by a potential difference between the brush 50 and the surface of the photoreceptor drum 11. In the image forming apparatus 1B, therefore, more developer can be stored in the brush 50, as compared to a case in which the developer is only scraped by contact between the fabric of the brush 50 and the surface of the photoreceptor drum 11. This lengthens the duration of release of the developer from the brush 50, which results in a more remarkable effect to prevent curls and abrasions of the blade.

In the image forming apparatus 1B, the charger 80 is not activated during low-density image formation. Accordingly, the surface of the photoreceptor drum 11 is not charged negatively. Then, by causing the brush 50 to have the same electric potential as the photoreceptor drum 11 or to have a negative electric potential relative to the photoreceptor drum 11, the developer stored in the brush 50 is released therefrom. In order to cause the brush 50 to have the same electric potential as the photoreceptor drum 11, that is, in order to cause the brush 50 to be 0V, the brush 50 may be connected not to the electric potential control circuit CC but to, for example, the ground. There is no other difference between the second modification and the embodiment above. Therefore, the description of the embodiment above also applies to the second modification other than the point that the charger is further provided in the second modification.

Other Embodiments

Image forming apparatuses according to the present invention are not limited to the embodiment and the modifications described above. For example, in the second modification, the charger 80 may be not a type to charge an object negatively but a type to charge an object positively. The image density threshold value used to determine whether or not it is a low-density image, the electric potential of each component, etc. may be designed arbitrarily. Further, the embodiment and the modifications may be combined.

Although the present invention has been described in connection with the preferred embodiments above, it is to be noted that various changes and modifications are possible. Such changes and modifications are to be understood as being within the scope of the invention.

What is claimed is:

1. An image forming apparatus comprising:

an image supporting member;

a developing device configured to supply a developer used to develop a latent image formed on the image supporting member to the image supporting member;

a transfer member configured to transfer the developed image from the image supporting member to a transfer medium;

a blade configured to remove the developer left on the image supporting member after transfer therefrom;

a storing member located downstream from the transfer member and upstream from the blade, the storing member configured to temporarily store a part of the developer left after transfer therein; and a control unit configured to control each component, wherein the storing member is controlled by the control unit to release the temporarily stored developer therefrom toward the image supporting member after a lapse of a predetermined time from when an image density, which is a ratio of a square measure of an image area to a square measure of a print medium, of an image to be formed becomes lower than a predetermined value, and the lower the image density is, the less the predetermined time is.

2. The image forming apparatus according to claim 1, wherein the developer contains toner, and antifriction serving to lower a coefficient of friction of a surface of the image supporting member.

3. The image forming apparatus according to claim 1, wherein:

an electric potential of the storing member relative to an electric potential of the image supporting member is variable; and the developer is released from the storing member by use of an electric potential difference between the storing member and the image supporting member.

4. The image forming apparatus according to claim 1, further comprising a charger located downstream from the transfer member and upstream from the storing member, the charger configured to charge the image supporting member.

5. The image forming apparatus according to claim 1, wherein the storing member is controlled by the control unit to stop releasing the developer therefrom when the image density becomes equal to or higher than the predetermined value.

6. The image forming apparatus according to claim 1, wherein the storing member is controlled by the control unit to stop releasing the developer therefrom after a lapse of a predetermined time from when the image density becomes equal to or higher than the predetermined value.

7. An image forming apparatus comprising:

an image supporting member;

a developing device configured to supply a developer used to develop a latent image formed on the image supporting member to the image supporting member;

a transfer member configured to transfer the developed image from the image supporting member to a transfer medium;

a blade configured to remove the developer left on the image supporting member after transfer therefrom;

a storing member located downstream from the transfer member and upstream from the blade, the storing member configured to temporarily store a part of the developer left after transfer therein; and a control unit configured to control each component, wherein the storing member is controlled by the control unit to release the temporarily stored developer therefrom toward the image supporting member after a lapse of a predetermined time from when an image density, which is a ratio of a square measure of an image area to a square measure of a print medium, of an image to be formed becomes lower than a predetermined value, and the predetermined time is changed depending on the image density.

* * * * *